US009649873B2

(12) United States Patent
Alzhrany

(10) Patent No.: US 9,649,873 B2
(45) Date of Patent: May 16, 2017

(54) WRITING INSTRUMENT WITH A LIGHT EMITTING DEVICE THAT DIRECTS GENERATED LIGHT TOWARDS A WRITING SURFACE

(71) Applicant: UMM AL-QURA UNIVERSITY, Makkah (SA)

(72) Inventor: Ahmad Alzhrany, Makkah (SA)

(73) Assignee: UMM AL-QURA UNIVERSITY, Makkah (SA)

( * ) Notice: Subject to any disclaimer, the term of this patent is extended or adjusted under 35 U.S.C. 154(b) by 60 days.

(21) Appl. No.: 14/730,668

(22) Filed: Jun. 4, 2015

(65) Prior Publication Data

US 2016/0355048 A1 Dec. 8, 2016

(51) Int. Cl.

| | |
|---|---|
| ***B43K 29/10*** | (2006.01) |
| ***F21L 4/00*** | (2006.01) |
| ***F21V 23/04*** | (2006.01) |
| ***B43K 25/02*** | (2006.01) |
| ***B43K 24/06*** | (2006.01) |

(52) U.S. Cl.

CPC ..... *B43K 29/10* (2013.01); *B43K 24/06* (2013.01); *B43K 25/026* (2013.01); *F21L 4/005* (2013.01); *F21V 23/0414* (2013.01)

(58) Field of Classification Search

CPC ..... B43K 29/10; B43K 24/06; B43K 25/026; F21L 4/005; F21V 23/0414

See application file for complete search history.

(56) References Cited

U.S. PATENT DOCUMENTS

| | | | | |
|---|---|---|---|---|
| 3,122,328 A * | 2/1964 | Weber | B43K 29/10 200/567 |
| 5,570,967 A * | 11/1996 | Chen | B43K 29/10 362/118 |
| 5,845,985 A * | 12/1998 | Xiong | B43K 29/10 362/109 |
| 6,926,421 B2 | 8/2005 | Huang | |
| 7,022,973 B2 * | 4/2006 | Huang | B43K 24/06 250/227.11 |
| 7,093,950 B2 * | 8/2006 | Kui | B43K 29/10 362/118 |
| 8,632,270 B2 * | 1/2014 | Liu | B43K 7/005 401/109 |
| 2007/0041177 A1 * | 2/2007 | Lin | B43K 29/10 362/118 |

* cited by examiner

*Primary Examiner* — Mary Ellen Bowman
(74) *Attorney, Agent, or Firm* — Oblon, McClelland, Maier & Neustadt, L.L.P.

(57) ABSTRACT

A writing instrument including a hollow cylindrical barrel with a first segment that is connected to a second segment, a tip located at a first longitudinal end of the barrel, a cap connected to the second segment that covers a second longitudinal end of the barrel and includes a clip, an ink cartridge, a battery, a light emitting device, a first actuator to extend and retract the writing end of the ink cartridge, and a second actuator to activate or deactivate the light emitting device. The light emitting device is located in the tip, at the end of the clip, or within the segmented barrel. The light is directed towards a writing surface based on proximity or directional lighting whereby the location of the light emitting device directs the light to the writing surface from the clip or down the length of the barrel.

19 Claims, 4 Drawing Sheets

WRITING INSTRUMENT WITH A LIGHT EMITTING DEVICE THAT DIRECTS GENERATED LIGHT TOWARDS A WRITING SURFACE

BACKGROUND OF THE INVENTION

Technical Field

The present invention relates to a writing instrument with a light emitting device that directs generated light towards a writing surface based on proximity of the light emitting device to the writing surface or by orientation of the light emitting device.

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

There are many writing instruments, for example, retractable ball-point pens, known in the art that have built-in lights, such as light emitting diodes (LEDs), thus making the pen usable in a dark environment. Usually, retractable pens with built-in lights work as follows: when a pen's writing end is extended out of the pen, the built-in light turns on, and when the pen's writing end is retracted, the light turns off. However, pens that function in this way have lights that are always on when the pen's writing end is out, regardless of the brightness of the environment. Lights that are continually turned on, even in a bright environment, reduce the light's battery life even though the light is not necessary for writing.

This shortcoming has been addressed with retractable light pens that have separate switches for turning a built-in pen light on and off [Lin, T. US20070041177A1; Weiliang, K. US7093950B2; Liu, L. US8632270B2; Huang, M. US7022973B2; Huang, M. US6926421B2—each incorporated herein by reference in its entirety]. However, these references disclose a light pen where the light emitting device is generally located within body of the pen, and the light is not directed towards a writing surface. Instead, the light generated causes these pens to glow and shine in multiple directions, but does not focus the beam of light towards the writing surface, which requires the most lighting.

In view of the forgoing, the objective of the present invention is to provide a writing instrument that has independent actuators for retracting the ink cartridge and activating a light emitting device, while also directing the light generated towards a writing surface based on proximity to the writing surface or by directional lighting from the location and orientation of the light emitting device.

BRIEF SUMMARY OF THE INVENTION

According to a first aspect, the present invention relates to a writing instrument including i) a hollow cylindrical barrel with a longitudinal central axis of extension and a first segment that is connected to a second segment ii) a tip located at a first longitudinal end of the barrel on the first segment iii) a cap connected to the second segment that covers a second longitudinal end of the barrel, wherein the cap includes a clip iv) an ink cartridge with a writing end located inside the barrel and the tip for dispensing ink onto a writing surface v) a battery vi) a light emitting device, which emits light onto the writing surface vii) a first actuator with a first rotably activated mechanism to extend and retract the writing end from and into the tip and viii) a second actuator with a second rotably activated mechanism to activate or deactivate the light emitting device. In terms of the present writing instrument, the mechanism of activation of the first actuator and the second actuator is circumferential to the longitudinal central axis of extension.

In one embodiment, the tip is twistably secured to the first longitudinal end of the barrel by screw threads.

In one embodiment, the first actuator is mechanically connected to the ink cartridge, and the mechanism of activation involves rotating the first actuator in a first direction to extend the writing end of the ink cartridge out of the tip, and rotating the first actuator in a second direction retracts the writing end into the tip.

In one embodiment, the connection between the cap and the second segment forms the first actuator, and the mechanism of activation involves rotating the cap relative to the second segment.

In one embodiment, the writing instrument further comprises a first conductive lead and a second conductive lead, wherein the battery is electrically connected to the light emitting device such that the device is activated when the first conductive lead and the second conductive lead are in contact.

In one embodiment, the connection between the first and second segment forms the second actuator, and the mechanism of activation involves rotating the first segment relative to the second segment.

In one embodiment, the first and second leads are in contact when the second actuator is rotated in a first direction, and the first and second leads are not in contact when the second actuator is rotated in a second direction.

In one embodiment, the tip is transparent.

In one embodiment, the light emitting device is located within the transparent tip, such that the writing instrument tip emits a light onto the writing surface when the first segment is rotated in a first direction relative to the second segment.

In one embodiment, the clip has a first end and a second end, and the first end of the clip is attached to the cap, and the second end of the clip points towards the tip of the writing instrument.

In one embodiment, the second end of the clip is in the form of a transparent bulb.

In one embodiment, the light emitting device is located within the transparent bulb, such that the writing instrument bulb emits a light onto the writing surface when the first segment is rotated in a first direction relative to the second segment.

In one embodiment, the inner diameter of the second segment is larger than the outer diameter of the first segment.

In one embodiment, the second segment overlaps the first segment such that they form concentric cylinders where a gap exists between the outer surface of the first segment and the inner surface of the second segment.

In one embodiment, the light emitting device is located within the gap formed by the overlapping first and second segment, such that the gap emits a light onto the writing surface when the first segment is rotated in a first direction relative to the second segment.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
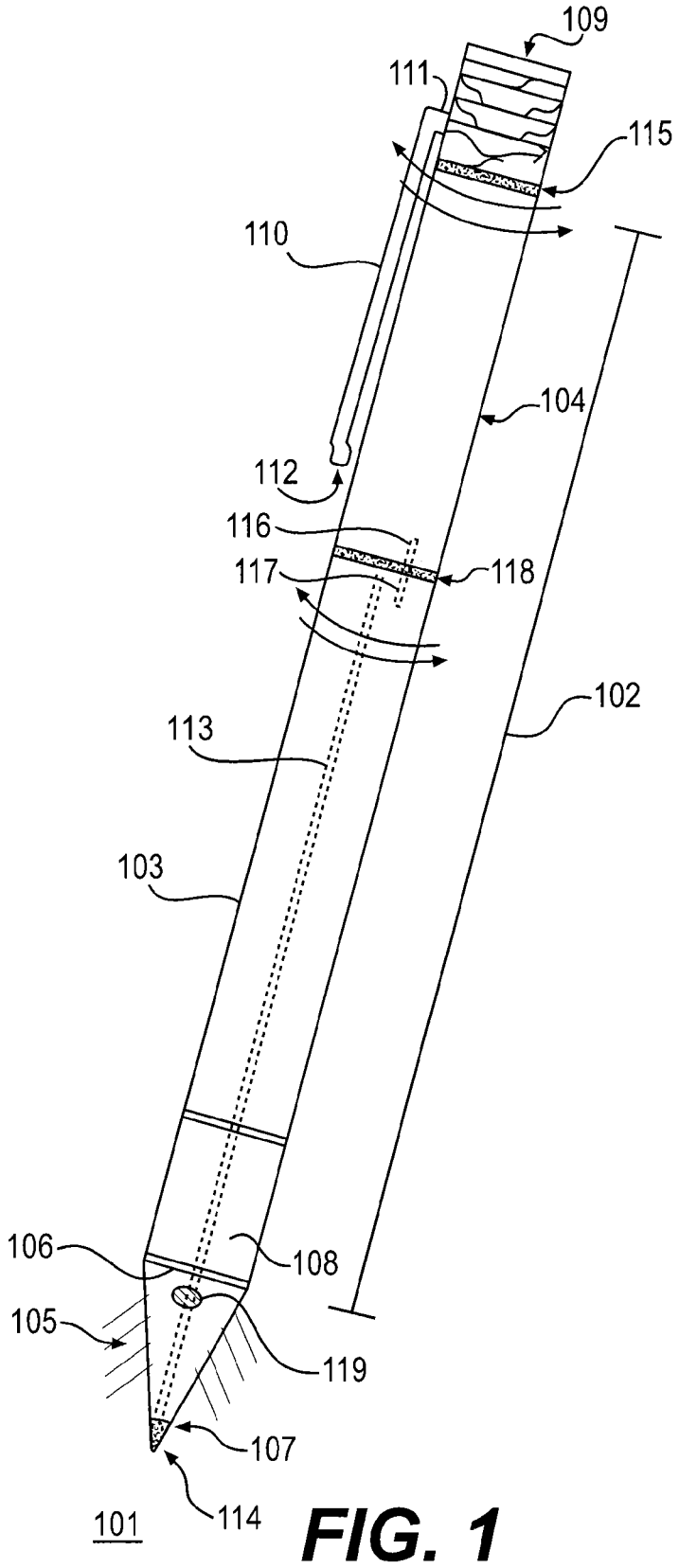
FIG. 1 is an illustration of the writing instrument with a single light emitting device located within the tip of the instrument.

Referring now to the drawings, wherein like reference numerals designate identical or corresponding parts throughout the several views.

Referring now to FIG. 1. According to a first aspect, the present invention relates to a writing instrument 101 including a hollow cylindrical barrel 102 with a longitudinal central axis of extension and a first segment 103 that is connected to a second segment 104. The segments of the hollow barrel may be removably attached to one another, or may be formed to each other, so long as the segments are able to rotate with respect to one another. Therefore, the first and second segment may be connected by threading, interlocking, and other connection types known to those of ordinary skill in the art.

The first and second segments of the present writing instrument may be connected to form a substantially flush connection, wherein the walls of the first segment continue as a smooth surface onto the walls of the second segment. Alternatively, the segments may be of differing size (i.e. diameter), where the connected segments are partially overlapping and the first segment fits inside the hollow barrel of the second segment such that the connection between the first and second segment is not flush.

Further, the size of the segments may be the same or different. In one embodiment, the barrel is divided into two equally sized segments where the first and the second segments have substantially the same dimension of length. Alternatively, the first and second segments that make up the barrel may be of differing lengths. In one embodiment, the first segment is longer than the second segment. In one embodiment, the first segment is 55-80, preferably 60-75, preferably 65-70% the length of the total barrel (the sum of the length of the first and the second segment).

The barrel of the present writing instrument may be made of plastic, ceramic, or metal. Exemplary materials include, but is not limited to, polyurethane, polyethylene terephthalate, polystyrene, polyvinyl chloride, polyethylene, polyester (PES), high-density polyethylene (HDPE), polyvinylidene chloride (PVDC), low-density polyethylene (LDPE), polypropylene (PP), high impact polystyrene (HIPS), polyamides (PA) (Nylons), polytetrafluoroethylene (PTFE), silnylon, acrylonitrile butadiene styrene (ABS), polyethylene/Acrylonitrile butadiene styrene (PE/ABS), polycarbonate (PC), polycarbonate/acrylonitrile butadiene styrene (PC/ABS), steel, copper, nickel, titanium, and alloys such as bronze.

In one embodiment, the first and second segments may be of the same material, or they may be different. For instance, the first segment may be transparent plastic, while the second segment is steel.

The writing instrument further includes a tip 105 located at a first longitudinal end of the barrel on the first segment. The tip is in the shape of a hollow frusto-cone, with a wide end 106 that is secured to the barrel and a narrow end 107 that is oriented towards a writing surface.

In one embodiment, the tip is twistably secured to the first longitudinal end of the barrel by screw threads. The twistably secured tip is flush with the walls of the cylindrical barrel when tightened, and may be removed from the barrel when loosened. Therefore, the tip may have female screw threads while the first end of the barrel has male screw threads. Alternatively, the tip may have male screw threads while the first end of the barrel has female screw threads.

In one embodiment, the writing instrument may further comprise a rubber grip 108 located on the first segment. The rubber grip is designed to be grasped and provide a better grip to a user when operating the writing instrument.

The writing instrument also includes a cap 109 connected to the second segment that covers a second longitudinal end of the barrel, wherein the cap includes a clip 110. The cap, together with the tip, enclose and secure the contents within the barrel. Similar to the barrel, the cap may be made from a plastic, ceramic, or metal, examples of which have been mentioned heretofore. The cap of the present instrument may be attached to or formed to the second barrel so long as they are able to rotate with respect to one another. Exemplary attachments include, thread and screwed, interlocked, partially embedded, etc.

One function of the clip is to secure the instrument to an article such as an article of clothes, a folder, paper, etc. In one embodiment, the clip has a first end 111 and a second end 112, and the first end of the clip is attached to the cap, and the second end of the clip points towards the tip of the writing instrument. The first end of the clip may be attached to or integrally formed with the cap, including interlocked, partially embedded, molded, glued, etc. In one embodiment, the clip is made of the same material as the cap. In an alternative embodiment, the clip may be made of a different material than the cap.

The writing instrument also contains an ink cartridge 113 with a writing end 114. The ink cartridge is secured inside the barrel and the tip and the writing end is for dispensing ink onto a writing surface. Therefore, the end of ink cartridge opposite of the writing end is inserted into and attached to the inside of the barrel, and the writing end is oriented in the same direction as the narrow end of the tip. The outer diameter of the ink cartridge is smaller than the inner diameter of both the barrel and the tip to allow easy extension and retraction of the ink cartridge. The mechanism by which the ink cartridge extends and retracts is well understood by those of ordinary skill.

The writing instrument also contains a battery. An electric battery is a device consisting of one or more electrochemical cells that convert stored chemical energy into electrical energy. Each cell contains a positive terminal, or cathode, and a negative terminal, or anode. Electrolytes allow ions to move between the electrodes and terminals, which allows current to flow out of the battery to perform work. The battery of the present disclosure may be a primary battery or a secondary battery. The type of battery is not important to the function of the pen so long as the battery can perform the desired function. Therefore, the battery may be, but is not limited to a galvanic cell, an electrolytic cell, a fuel cell, a flow cell, and a voltaic pile. Exemplary battery types include a wet cell (e.g. nickel-cadmium), a dry cell (e.g. zinc-carbon), a molten salt, etc. The battery may be a single use, or a rechargeable battery. Exemplary rechargeable batteries include nickel-cadmium (NiCd), nickel-zinc (NiZn), nickel metal hydride (NiMH), and lithium-ion (Li-ion) cells. The rechargeable battery is located within the writing instrument, and may be removed for recharging, or may be charged while present in the writing instrument through a direct cable connection to a wall-powered outlet.

The writing instrument also includes a light emitting device 119, which emits light onto the writing surface. The primary function of the light emitting device is to provide light to a user when in a dimly lit area. Therefore, the light emitting device may take on any form of lighting that accomplishes this function. Exemplary light emitting devices include a ballast, a fluorescent light, a halogen light, a neon light, a light emitting diode, and a compact fluorescent lamp.

A light-emitting diode (LED) is a two-lead semiconductor light source. It is a pn-junction diode, which emits light when activated. When a suitable voltage is applied to the leads, electrons are able to recombine with electron holes within the device, releasing energy in the form of photons. This effect is called electroluminescence, and the color of the light (corresponding to the energy of the photon) is determined by the energy band gap of the semiconductor. An LED is often small in area (less than 1 mm) and integrated optical components may be used to shape its radiation pattern. In one embodiment, the light emitting device is a light emitting diode. The LED may be a semiconductor light-emitting diode (LED), organic light-emitting diode (OLED), or polymer light-emitting diodes (PLED). The LED may use a variety of semiconductors, organic materials, or polymers. Examples that may be used in an LED light emitting device of the present disclosure include, but are not limited to, gallium arsenide (GaAs), aluminum gallium arsenide (AlGaAs), gallium arsenide phosphide (GaAsP), aluminum gallium indium phosphide (AlGaInP), gallium (III) phosphide (GaP), gallium(III) nitride (GaN), indium gallium nitride (InGaN), zinc selenide (ZnSe), silicon carbide (SiC), boron nitride, aluminum nitride (AlN), poly(p-phenylene vinylene), polyfluorene, $Ir(mppy)_3$-based materials, $Alg_3$-based materials, and perylene, rubrene and quinacridone derivatives.

In terms of the present disclosure, a mechanical system manages power to accomplish a task that involves forces and movement. A mechanical system consists of (i) a power source and actuators that generate forces and movement, (ii) a system of mechanisms that shape the actuator input to achieve a specific application of output forces and movement.

The mechanism of a mechanical system is assembled from components called machine elements. These elements provide structure for the system and control its movement. The structural components are, generally, the frame members, bearings, splines, springs, seals, fasteners and covers. The assemblies that control movement are also called mechanisms. Mechanisms are generally classified as gears and gear trains, which includes belt drives and chain drives, cam and follower mechanisms, and linkages, though there are other special mechanisms such as clamping linkages, indexing mechanisms, escapements and friction devices such as brakes and clutches. Other mechanical mechanisms include levers, wheel and axles, pulleys, inclined planes, wedges, and screws.

In terms of the present disclosure, an actuator refers to any mechanical component that accepts the transfer of force or movement and applies the operating force to the mechanical system. The actuator may refer to a rotor, a button, a toggle, a rocker, a switch, or any mechanical linkage such as a scale, a lever, or a gear. The actuator may also be a sliding member, a twisting member, or a threaded twisting member.

The writing device also includes a first actuator 115 with a first rotably activated mechanism to extend and retract the writing end from and into the tip.

Further, the writing device contains a second actuator with a second rotably activated mechanism to activate or deactivate the light emitting device.

In terms of the present writing instrument, the mechanism of activation of the first actuator and the second actuator is circumferential to the longitudinal central axis of extension.

In one embodiment, the first actuator is mechanically connected to the ink cartridge, and the mechanism of activation involves rotating the first actuator in a first direction to extend the writing end of the ink cartridge out of the tip, and rotating the first actuator in a second direction retracts the writing end into the tip. The rotation in the first direction may be clockwise or counter-clockwise, and the rotation in the second direction must be opposite of that of the first direction.

In one embodiment, the connection between the cap and the second segment forms the first actuator, and the mechanism of activation involves rotating the cap relative to the second segment. Therefore, the cap and the second segment, while connected, may be rotated to actuate movement of the ink cartridge in a direction along the longitudinal central axis of extension of the barrel to place the writing instrument in a position for writing or a non-writing position.

In one embodiment, the writing instrument further comprises a first conductive lead 116 and a second conductive lead 117, wherein the battery is electrically connected to the light emitting device such that the light emitting device is activated when the first conductive lead and the second conductive lead are in contact.

In one embodiment, the connection between the first and second segment forms the second actuator 118, and the mechanism of activation involves rotating the first segment relative to the second segment.

In one embodiment, the first and second leads are in contact when the second actuator is rotated in a first direction, and the first and second leads are not in contact when the second actuator is rotated in a second direction.

The leads of the writing instrument may be located within the barrel on different segments, i.e. one lead is attached to the first segment, and the second lead is attached to the second segment. When the second actuator is rotated in a first direction the leads are aligned and are therefore in contact. The alignment of the leads completes a circuit and allows the flow of electricity from the battery to the light emitting device, turning the light emitting device to an "on" position. On the other hand, rotating the second actuator in a second direction causes the leads to move out of alignment with each other, disrupting the circuit and turning the light emitting device to an "off" position.

Figure 2:
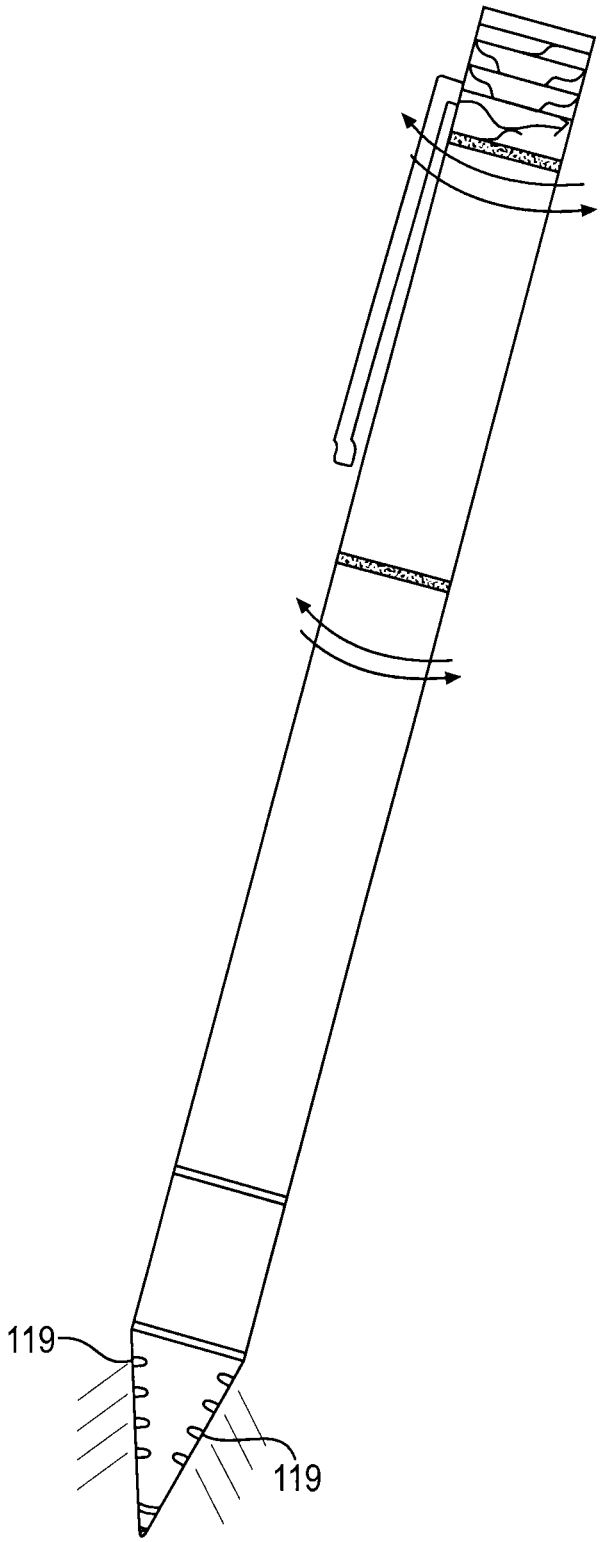
FIG. 2 is an illustration of the writing instrument with a plurality of light emitting devices located within the tip of the instrument.

Referring now to FIG. 2, which illustrates one embodiment of the writing instrument. In one embodiment, the tip is transparent. In one embodiment, the light emitting device 119 is located within the transparent tip, such that the writing instrument tip emits a light onto the writing surface when the first segment is rotated in a first direction relative to the second segment. The light emitting device is advantageously attached to the inside wall of the tip. It is envisaged that the tip may contain one light emitting device, or a plurality of light emitting devices. In the case of multiple light emitting devices, the device may be attached around the circumference of the inside of the frusto-conical tip. In such a case, the device may be circumferentially equally spaced apart. Further, the light emitting device may be attached at a variety of vertically separated levels around the frusto-conical tip.

In this embodiment, light is directed towards the writing surface based on the close proximity of the light, which is in the pen tip, to the writing surface.

Figure 3:
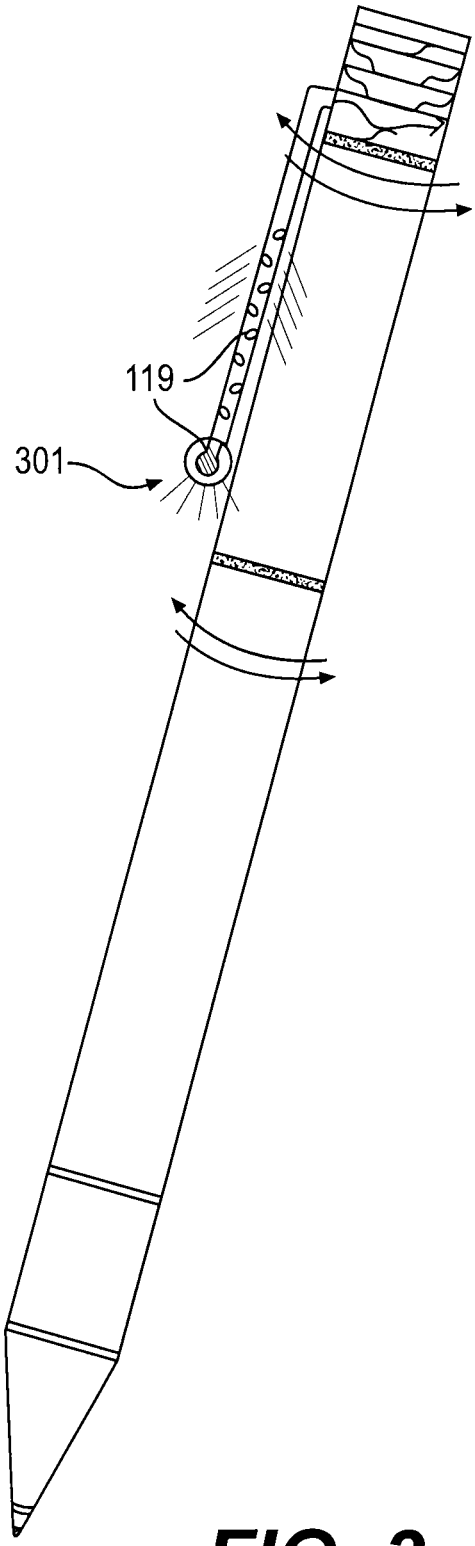
FIG. 3 is an illustration of the writing instrument with a light emitting device in the clip of the instrument cap, and directional lighting based on the orientation of the clip pointing towards the writing surface.

Referring now to FIG. 3, in one embodiment, the second end of the clip is in the form of a transparent bulb 301. In one embodiment, the light emitting device is located within the transparent bulb, such that the writing instrument bulb emits a light onto the writing surface when the first segment is rotated in a first direction relative to the second segment.

In addition to the light emitting device being located within a bulb-containing clip, it is envisaged that the clip may be adapted to house a plurality of light emitting devices 119 within the clip structure. In this scenario, the clip is made of a transparent material, and the handle portion of the clip is hollow. The "handle" refers to any portion of the clip in between the first end and the second end. The plurality of light emitting devices may then be housed within the hollow clip handle. This feature of the clip may be present in addition to the presence of bulb as the second end of the clip, or as a stand-alone feature.

In this embodiment, the light is directed towards the writing surface based on directional lighting, whereby the location of the light emitting device directs the light toward the writing surface by the orientation of the clip.

Figure 4:
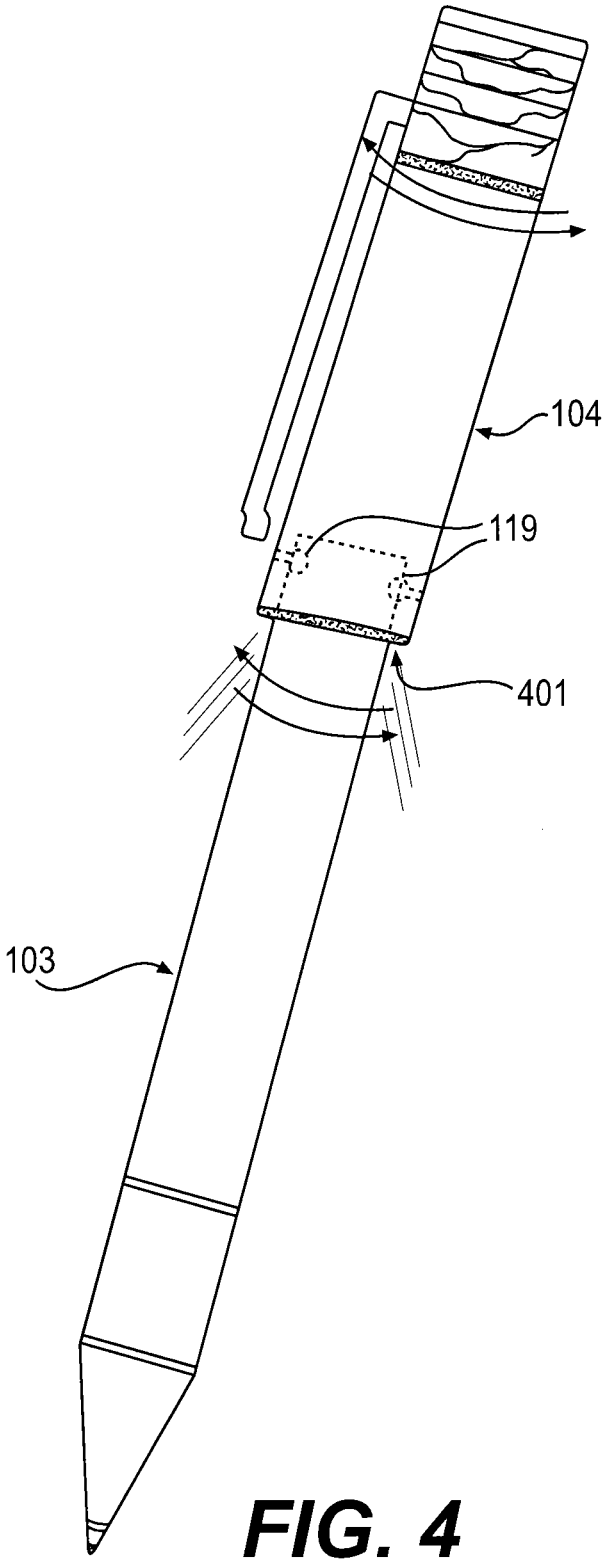
FIG. 4 is an illustration of the writing instrument with a light emitting device located in between the segments of the segmented barrel, and directional lighting based on orienting/channeling the light down the length of the barrel towards the writing surface.

As best illustrated in FIG. 4, in one embodiment, the inner diameter of the second segment is larger than the outer diameter of the first segment. In one embodiment, the second segment overlaps the first segment such that they form concentric cylinders where a gap 401 exists between the outer surface of the first segment and the inner surface of the second segment.

In one embodiment, the light emitting device is located within the gap formed by the overlapping first and second segment, such that the gap emits a light onto the writing surface when the first segment is rotated in a first direction relative to the second segment. The light emitting device may be attached to the inside wall, at an overlapping part, of the second segment. Alternatively, the light emitting device may be attached to the outside wall, at an overlapping part, of the first segment. It is envisaged that the gap may contain one light emitting device, or a plurality of light emitting devices. In the case of multiple light emitting devices, the device may be attached around the circumference of the outside wall of the first segment, or around the inside wall of the second segment. In such a case, the device may be circumferentially equally spaced apart. Further, the light emitting device may be attached to the first segment, or alternatively the second segment, at a variety of vertically separated levels around the cylindrical segments.

In this embodiment, the light is directed towards the writing surface based on directional lighting, whereby the location of the light emitting device inside the segmented barrel directs the light toward the writing surface by orienting/channeling the light down the length of the barrel.

The writing instrument of the present disclosure, in one or more of its embodiments, is a pen. In one embodiment, the pen may be a ballpoint pen, a fountain pen, a marker, or a roller ball pen. The type of pen is meant to be non-limiting, so long as the writing instrument performs as intended. Therefore, any type of ink may be used in the ink cartridge, including, but not limited to, black ink, blue ink, red ink, highlighter ink, including any ink that contains other ingredients, such as solvents, pigments, dyes, resins, lubricants, solubilizers, surfactants, particulate matter, and fluorescents. The presence and location of the light emitting device in the writing instrument, in one or more of its embodiments, allows the pen to be used in the dark or dimly light areas with low or below normal levels of lighting. The writing instrument is therefore designed to illuminate a writing surface (e.g. paper, cloth, etc.) using the light emitting device or devices. In general, the light emitting devices of the present disclosure are oriented to direct light towards the writing surface, although not all of the light can be directed in a singular direction. The presence of two individual actuators on the writing device allows a user to independently control the use of the ink cartridge and to control the "on-off" capabilities of the light. Therefore, the pen may be used for writing in a well-lit area without the use of the light, and conversely, the light may be used on the writing device without the writing end of the ink cartridge engaged for writing.

Further, it is envisaged that the writing device, in one or more of its embodiments, may be adapted with a dimmer mechanism to control the brightness of light emitted from the light emitting device. For instance, the second actuator could adapt several positions along the path of movement (i.e. circumferential to the longitudinal central axis of extension of the barrel), where each position provides a different level of light, for example, an off position, a first brightness level, and a second brightness level. Alternatively, the writing instrument may include a gradient dimmer mechanism to provide a gradient of light/dimness. The gradient dimmer could be a part of the second actuator, where rotating the second actuator by more or less rotational degrees controls the level of brightness. Conversely, a separate actuator, such as a twist knob or toggle lever, may be used to control the light produced by the light emitting device.

It is envisaged that in addition to being a pen, that the writing device of the present disclosure may be adapted for use as a mechanical pencil, or another type of instrument that may require the use of light, in addition to its main function. Exemplary devices include, a glue gun, a painting device, and an eraser.

The invention claimed is:

1. A writing instrument, comprising:

a hollow cylindrical barrel with a longitudinal central axis of extension and a first segment that is connected to a second segment;

a tip located at a first longitudinal end of the barrel on the first segment;

a cap connected to the second segment that covers a second longitudinal end of the barrel, wherein the cap includes a clip;

an ink cartridge with a writing end located inside the barrel and the tip for dispensing ink onto a writing surface;

a battery;

a light emitting device, which emits light onto the writing surface;

a first actuator with a first rotably activated mechanism to extend and retract the writing end from and into the tip;

a second actuator with a second rotably activated mechanism to activate or deactivate the light emitting device;

wherein the connection between the first and second segment forms the second actuator, and the mechanism of activation involves rotating the first segment relative to the second segment; and wherein the mechanism of activation of the first actuator and the second actuator is circumferential to the longitudinal central axis of extension.

2. The writing instrument of claim 1, wherein the tip is twistably secured to the first longitudinal end of the barrel by screw threads.

3. The writing instrument of claim 1, wherein the first actuator is mechanically connected to the ink cartridge, and the mechanism of activation involves rotating the first actuator in a first direction to extend the writing end of the ink cartridge out of the tip, and rotating the first actuator in a second direction retracts the writing end into the tip.

4. The writing instrument of claim 3, wherein the connection between the cap and the second segment forms the first actuator, and the mechanism of activation involves rotating the cap relative to the second segment.

5. The writing instrument of claim 4, further comprising a first conductive lead and a second conductive lead, wherein the battery is electrically connected to the light emitting device such that the device is activated when the first conductive lead and the second conductive lead are in contact.

6. The writing instrument of claim 5, wherein the first and second leads are in contact when the second actuator is rotated in a first direction, and the first and second leads are not in contact when the second actuator is rotated in a second direction.

7. The writing instrument of claim 6, wherein the tip is transparent.

8. The writing instrument of claim 7, wherein the light emitting device is located within the transparent tip, such that the writing instrument tip emits a light onto the writing surface when the first segment is rotated in a first direction relative to the second segment.

9. The writing instrument of claim 6, wherein the clip has a first end and a second end, and the first end of the clip is attached to the cap, and the second end of the clip points towards the tip of the writing instrument.

10. The writing instrument of claim 9, wherein the second end of the clip is in the form of a transparent bulb.

11. The writing instrument of claim 10, wherein the light emitting device is located within the transparent bulb, such that the writing instrument bulb emits a light onto the writing surface when the first segment is rotated in a first direction relative to the second segment.

12. The writing instrument of claim 6, wherein the inner diameter of the second segment is larger than the outer diameter of the first segment.

13. The writing instrument of claim 12, wherein the second segment overlaps the first segment such that they form concentric cylinders where a gap exists between the outer surface of the first segment and the inner surface of the second segment.

14. The writing instrument of claim 13, wherein the light emitting device is located within the gap formed by the overlapping first and second segment, such that the gap emits a light onto the writing surface when the first segment is rotated in a first direction relative to the second segment.

15. The writing instrument of claim 7, wherein a plurality of light emitting devices are attached to and circumferentially spaced apart around an inside of the tip.

16. The writing instrument of claim 10, wherein the clip is hollow and transparent, and wherein the light emitting device is located both within the transparent bulb and within the hollow clip.

17. The writing instrument of claim 14, wherein a plurality of light emitting devices are attached to and circumferentially spaced apart around the circumference of the outer surface of the first segment within the gap or attached to and circumferentially spaced apart around the circumference of the inner surface of the second segment within the gap.

18. The writing instrument of claim 1, wherein the second actuator adopts a first position along a path of movement to activate the light emitting device to produce light with a first brightness level and a second position along a path of movement to produce light with a second brightness level.

19. The writing instrument of claim 1, wherein:

the first actuator is mechanically connected to the ink cartridge, the connection between the cap and the second segment forms the first actuator, and the mechanism of activation involves rotating the cap relative to the second segment to extend or retract the writing end of the ink cartridge out of or into the tip;

the inner diameter of the second segment is larger than the outer diameter of the first segment, and the second segment overlaps the first segment such that they form concentric cylinders where a gap exists between an outer surface of the first segment and an inner surface of the second segment;

the light emitting device is attached to the inner surface of the second segment within the gap formed by the overlapping first and second segment, such that the gap emits a light onto the writing surface when the first segment is rotated in a first direction relative to the second segment; and the second actuator adopts a first position along a path of movement to activate the light emitting device to produce light with a first brightness level and a second position along a path of movement to produce light with a second brightness level.

* * * * *